US006300733B1

(12) United States Patent
Bergstrom

(10) Patent No.: US 6,300,733 B1
(45) Date of Patent: Oct. 9, 2001

(54) SYSTEM TO DETERMINE SOLENOID POSITION AND FLUX WITHOUT DRIFT

(76) Inventor: Gary E. Bergstrom, 191 Miles Rd., Moreland Hills, OH (US) 44022

( * ) Notice: Subject to any disclaimer, the term of this patent is extended or adjusted under 35 U.S.C. 154(b) by 0 days.

(21) Appl. No.: 09/790,136

(22) Filed: Feb. 21, 2001

Related U.S. Application Data

(60) Provisional application No. 60/183,980, filed on Feb. 22, 2000.

(51) Int. Cl.[7] ..... H01H 47/04; H01H 47/00

(52) U.S. Cl. ..... 318/128; 361/160; 361/154

(58) Field of Search ..... 310/68 R, 68 B, 310/68 C; 361/187, 152, 154, 160; 318/128, 127, 126

(56) References Cited

U.S. PATENT DOCUMENTS

| | | | |
|---|---|---|---|
| 3,671,814 | 6/1972 | Dick | 361/154 |
| 3,697,840 | 10/1972 | Koch | 318/138 |
| 4,434,450 | 2/1984 | Gareis | 361/152 |
| 4,450,427 | 5/1984 | Gareis | 361/154 |
| 4,608,620 | 8/1986 | Hines | 250/201.5 |
| 4,656,400 | 4/1987 | Pailthrop et al. | 318/135 |
| 4,665,348 | 5/1987 | Stupak | 250/201.5 |
| 5,117,869 | 6/1992 | Kolchinsky | 137/625.65 |
| 5,406,440 | 4/1995 | Wieloch | 327/385 |
| 5,442,515 | 8/1995 | Wallaert | 361/187 |
| 5,546,268 | 8/1996 | Hurley et al. | 361/160 |
| 5,635,784 | 6/1997 | Seale | 310/40 MM |
| 5,933,313 | 8/1999 | Furukawa | 361/154 |
| 6,208,497 * | 3/2001 | Seale et al. | 361/160 |

* cited by examiner

*Primary Examiner*—Nicholas Ponomarenko
*Assistant Examiner*—Judson H. Jones
(74) *Attorney, Agent, or Firm*—Pierce Atwood; Chris A. Caseiro; Patrick R. Scanlon

(57) ABSTRACT

A system for measuring and controlling solenoid armature position. The system determines inductive voltage in the drive winding of the solenoid, integrates that voltage to obtain flux, and uses the current/flux ratio to measure armature position. To overcome integration drift, the current/flux position measure is compared to an independent position measure, this comparison leading to a drift correction. In an embodiment maintaining a servo-controlled position, flux drift causes position drift and current drift, the latter providing an independent measure of position drift and flux drift, permitting drift correction. In a second embodiment, a high frequency component of the drive voltage (possibly from pulse width modulation) and a high frequency current measurement provide the independent measure of position.

14 Claims, 4 Drawing Sheets

SYSTEM TO DETERMINE SOLENOID POSITION AND FLUX WITHOUT DRIFT

CROSS REFERENCE TO RELATED APPLICATION

This application claims the priority benefit of U.S. provisional application Ser. No. 60/183,980, filed Feb. 22, 2000, of the same title and filed by the same inventor. The contents of that application are incorporated herein by reference.

BACKGROUND OF THE INVENTION

1. Field of the Invention

This invention relates to correcting the drift associated with the determination of position and flux in variable reluctance devices such as solenoids. This drift is present in systems that integrate a measured parameter of the device in order to determine flux and position.

2. Description of the Prior Art

The prior art related to the present invention includes many techniques to determine the position of a solenoid. Some systems add a position sensor, which increases the cost and complexity. Others have attempted to infer position from signals that either exist on the system or are cheaper to generate than including a position sensor. Jayawant (U.S. Pat. NO. 5,467,244) describes a measurement system that balances the position of a solenoid. Stupak (U.S. Pat. No. 4,659,969) uses a Hall sensor to measure flux. Gingrich (U.S. Pat. No. 4,368,501) shows how to generate flux (Φ) from a second winding. The desirability of flux information comes from the approximation equation relating flux (Φ), measured current (I) through the winding, and position:

$$x' = I/\Phi \qquad \text{Equation 1}$$

where x' is only an approximation of true position x. In many systems the approximation is either good enough, or it is not too difficult to transform x' into x.

Flux (Φ) can be obtained from the applied inductive voltage VL, as:

$$VL = Vapplied - I * R \qquad \text{Equation 2}$$

where I is the measured current, R is the resistance of the coil in the solenoid, and Vapplied is the voltage applied across the coil. VL and flux are related with the equation:

$$V_L = n * \frac{d\Phi}{dt} \qquad \text{Equation 3}$$

where n is the number of turns on the solenoid.
Integrating equation 3 gives:

$$\Phi + k2 = \int \frac{d\Phi}{dt} dt = \int \frac{V_L}{n} dt \qquad \text{Equation 4}$$

where k2 is a constant having to do with the initialization of the integrator.

Therefore the known applied voltage can be integrated, combined with the measured current, and used to obtain x' for a reasonably behaved device. But a problem in all of the systems that measure flux by doing an integration, such as Gingrich's, is that over time the integral will drift. Since the value of flux drifts from its correct value, the determination of x' will also drift (equation 1). The system will be accurate when the flux integrator can be initialized to a known state, such as zero when an unpowered system is first energized. As time passes, the drift will cause the integrator to deviate more and more from the correct value. Knowing the absolute position from some other information can also be used to initialize the integrator, since equation 1 can be solved for flux (current I and position x' being known). Certain systems, such as engine valves, quickly move from one known location to another and so are not a problem. But many valves and solenoids must hold a driven position for long periods of time, and cannot rely upon the chance that they will move to a known boundary condition and allow the integrator to be corrected within the short period of time that drift remains a small error.

The derived measurement of flux is not the only way to control position. Others have made systems that attempt to control the position of a solenoid by holding a constant current in the coil of the solenoid without employing feedback. Still others have attempted to measure the inductance of the device, since inductance can usually be converted into position for this type of device. One such method is to apply a known high frequency drive and use the resultant high frequency ripple in a measured signal such as current to calculate inductance. The constant current drive method has errors relating to the lack of any feedback, and the inductance measurement technique has been hampered with noise and measurement accuracy problems.

SUMMARY OF THE INVENTION

The system of the present invention combines ideas from the above systems in a new way to produce a system having the best characteristics of each. High frequency position information is acquired with the current over flux (I/Φ) technique described above. This method gives excellent results from frequencies above the high frequency mechanical response of the system (the fastest it can practically go), to frequencies as low a 1 Hz or lower, dependent upon the accuracy of the flux integral in equation 4. The low frequency drift of the integrator in this new system is then corrected by using one of a number of techniques, to be described below, allowing performance from DC to high frequency.

SUMMARY OF THE DRAWINGS

Figure 1:
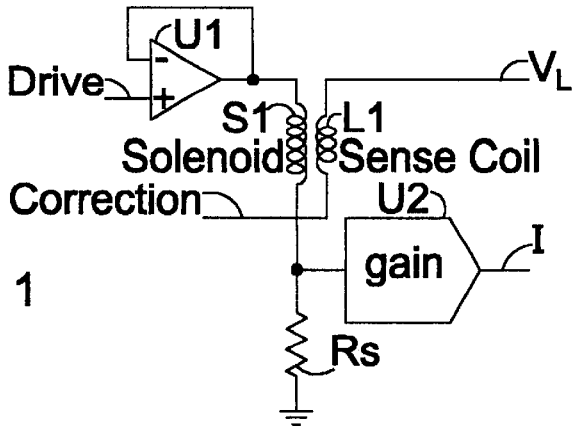
FIG. 1, from prior art, shows a system using a sense coil to obtain VL, and a current sensor.

FIG. 1 shows prior art for obtaining current information (I), and the voltage $V_L$ which equals the change of flux with time (n dΦ/dt). $V_L$ is obtained with a separate sense coil L1. The signal Correction in this figure is an offset signal that can be used to correct DC offsets in subsequent hardware or software that may be connected to output signal $V_L$. The Drive signal is shown being amplified by U1. This amplifier must be capable of driving the solenoid coil, S1, but the details of how it accomplishes that are not important here. Current sense signal I is obtained by measuring the drop in voltage across a small resistor $R_s$ and amplifying with a gain (via U2) appropriate for the system.

Figure 2:
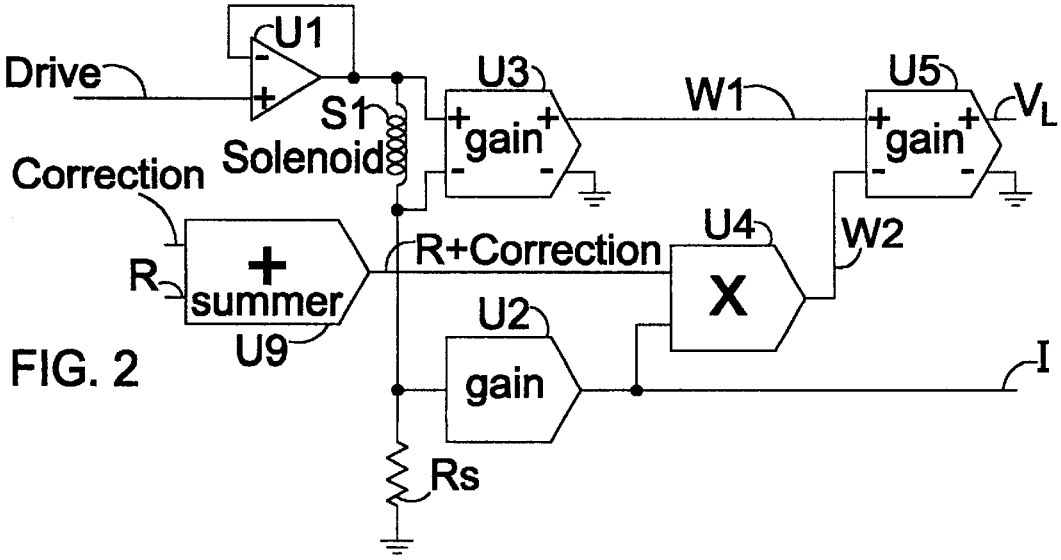
FIG. 2, from prior art, shows a system that measures applied voltage to obtain VL, and a current sensor.
Figure 3:
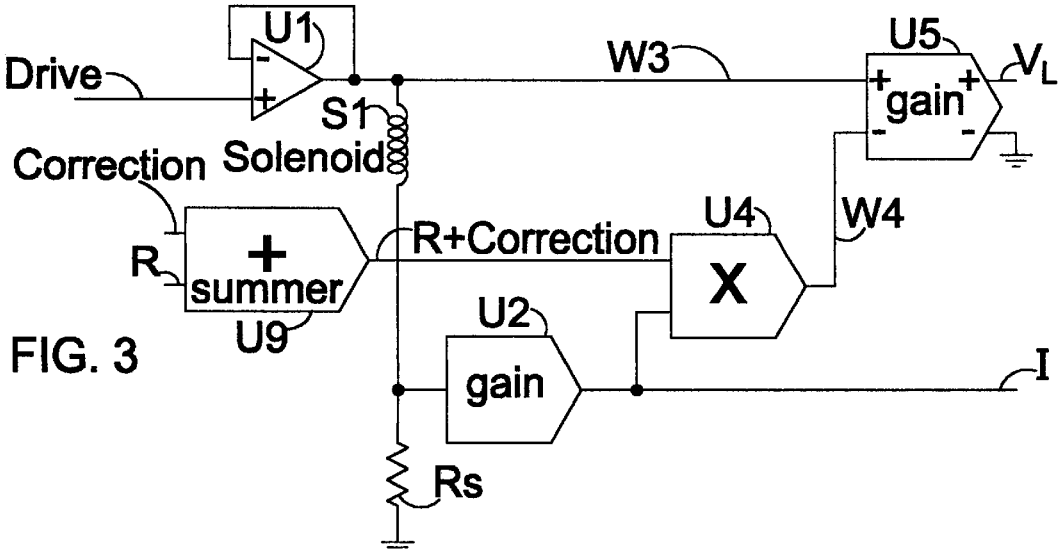
FIG. 3, from prior art, shows a system that only measures current, and computes VL.

The Drive and current sense output (I) in FIGS. 2 and 3 are the same as in FIG. 1. FIG. 2 removes the sense coil (L1) from the solenoid and uses instead a means to compute $V_L$. This is accomplished in FIG. 2 by using differential amplifier U3 to convert the applied voltage across the coil to signal W1. W1 is $V_{applied}$ from equation 2. W2 is calculated by U4 to be I * R from equation 2. The Correction signal is now summed with the resistance estimate R of the solenoid coil at summer U9, providing an input for multiplier U4, whose other input is the current signal I from U2, the same current sense amplifier as in FIG. 1. The difference amplifier U5 then computes $V_L$ from W1 and W2.

FIG. 3 is like FIG. 2, except that it is noted that U3 can be eliminated if the value for resistance in calculating I * R in equation 2 is the sum of sense resistor $R_s$ and the resistance of the coil. This sum is now combined with the Correction signal yielding signal W4 which is applied to multiplier U4 as in FIG. 2. The two inputs to U5 are now W3, which is the applied voltage plus the drop across the sense resistor Rs, and W4, the product of I * R also including the drop across the sense resistor $R_s$. The sense resistor term drops out, simplifying to just $V_L$. This simplification yields the same result as FIG. 2, but with reduced hardware/software.

Figure 4:
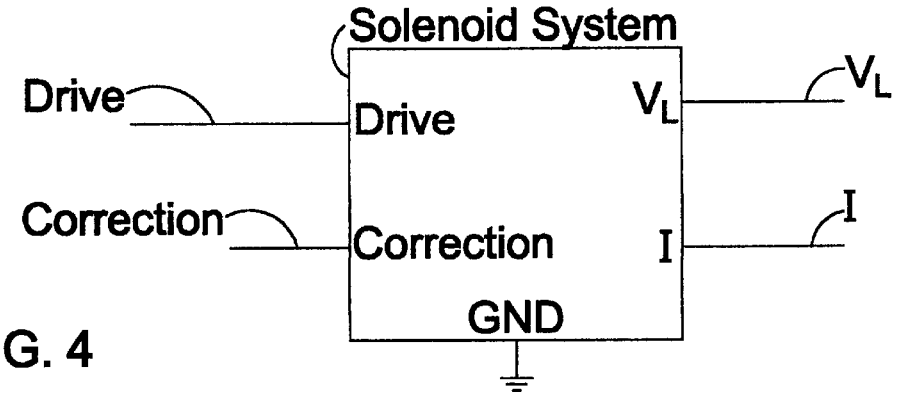
FIG. 4, from prior art, shows the solenoid positioning system of the present invention.

FIG. 4 is a simplified representation of the systems of FIGS. 1–3without the individual details.

Figure 5:
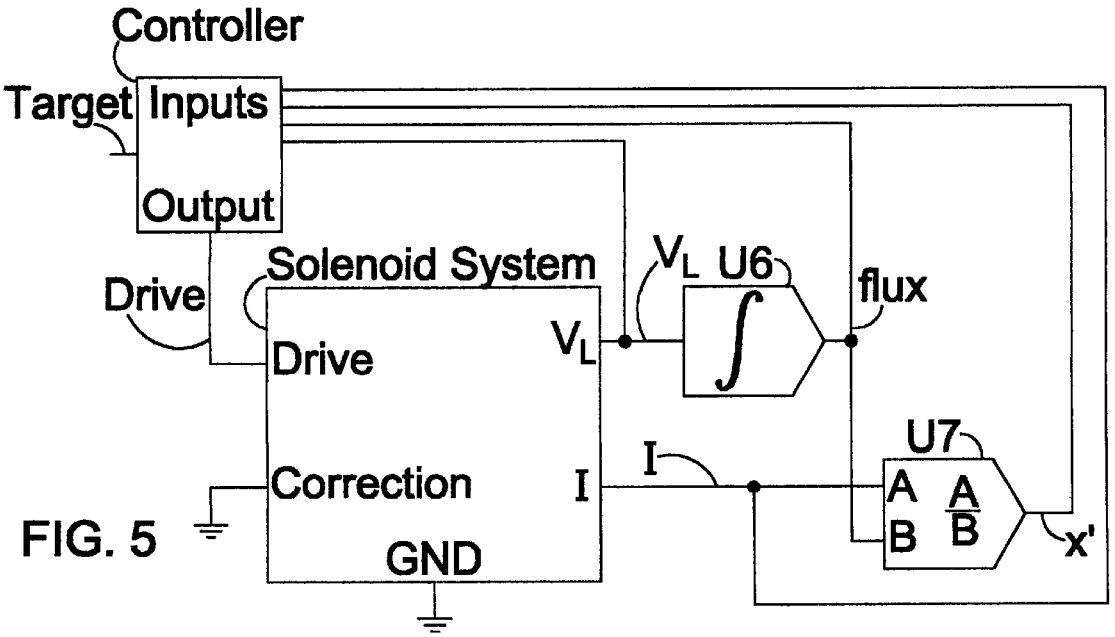
FIG. 5, from prior art, shows a simple closed loop position system built around the solenoid and measurement block of FIG. 4.

FIG. 5 shows a controller incorporating a number of feedback elements to control the solenoid. Note that most, if not all, of these blocks may be accomplished through software on a controller, rather than hardware. The solenoid system of FIG. 4 is used, where the system inside may be any of the prior art FIGS. 1, 2, or 3. Correction is not implemented and is drawn as zero (connected to ground).

Figure 6:
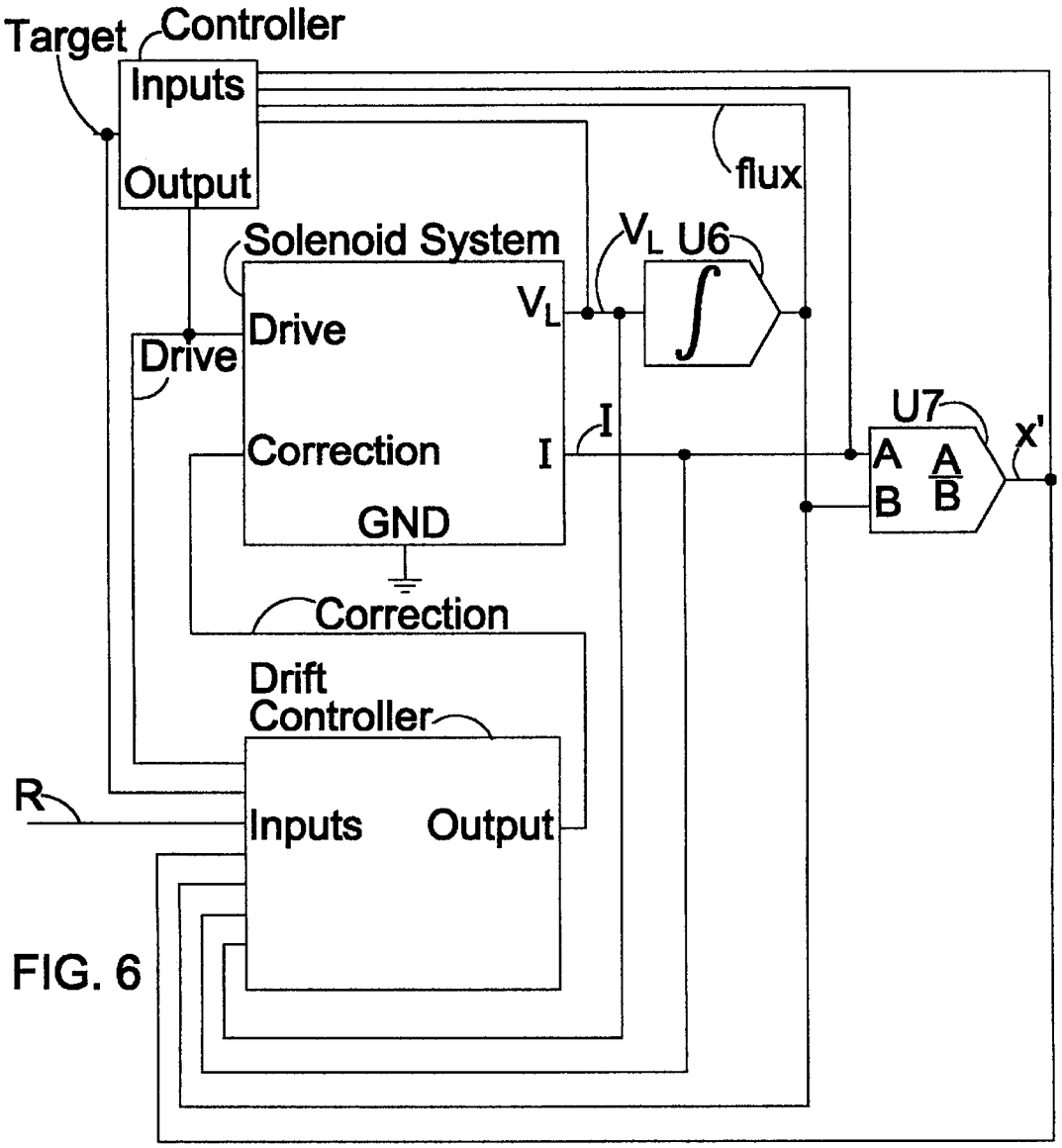
FIG. 6, shows the system of FIG. 5 with the addition of a drift controller of the present invention to stabilize the flux integration.

FIG. 6 is a block diagram of the present invention. To the prior art in FIG. 5 is added a Drift Controller whose inputs are all of the signals present from FIG. 5 and whose output is the Correction term to the Solenoid System. The drift controller uses one of the procedures described below. Which procedure will be the choice of the designer, given the system and performance requirements. All of the signals supplied to the drift controller need not be used in any one implementation, but different combinations (including all) may be needed for different procedures. In a physical realization of FIG. 6, the Drift Controller and the Controller will usually be the same controller performing both tasks.

Figure 7:
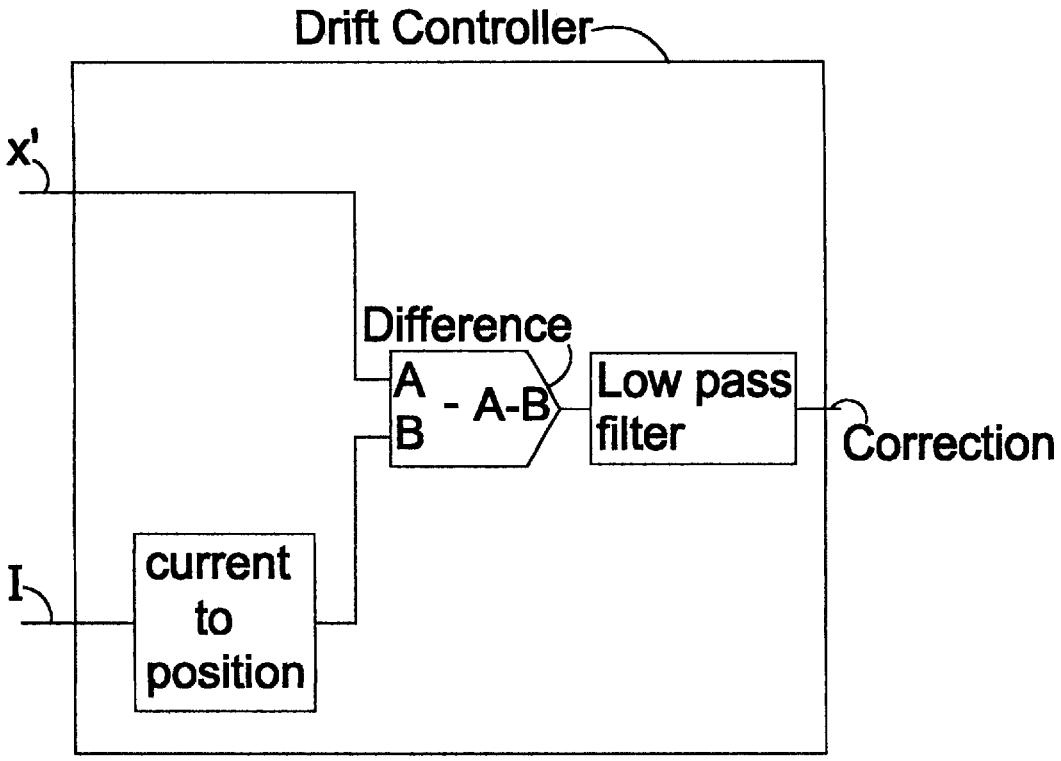
FIG. 7, shows an embodiment of the drift controller that uses DC current to define position.

FIG. 7 is a block diagram showing how to use current to correct the slow drift of the flux integrator. The current over flux (I/Φ) position X' is compared to a function that converts current to position. This difference is then filtered and applied as the correction to the Solenoid System. As noted below, the accuracy of the difference as a measure is dependent upon the system to which this is applied. Even for applicable systems, current is only a measure of position when the system is not moving, requiring a low pass filter to remove the high frequency motion artifacts before applying the correction to the Solenoid System.

Figure 8:
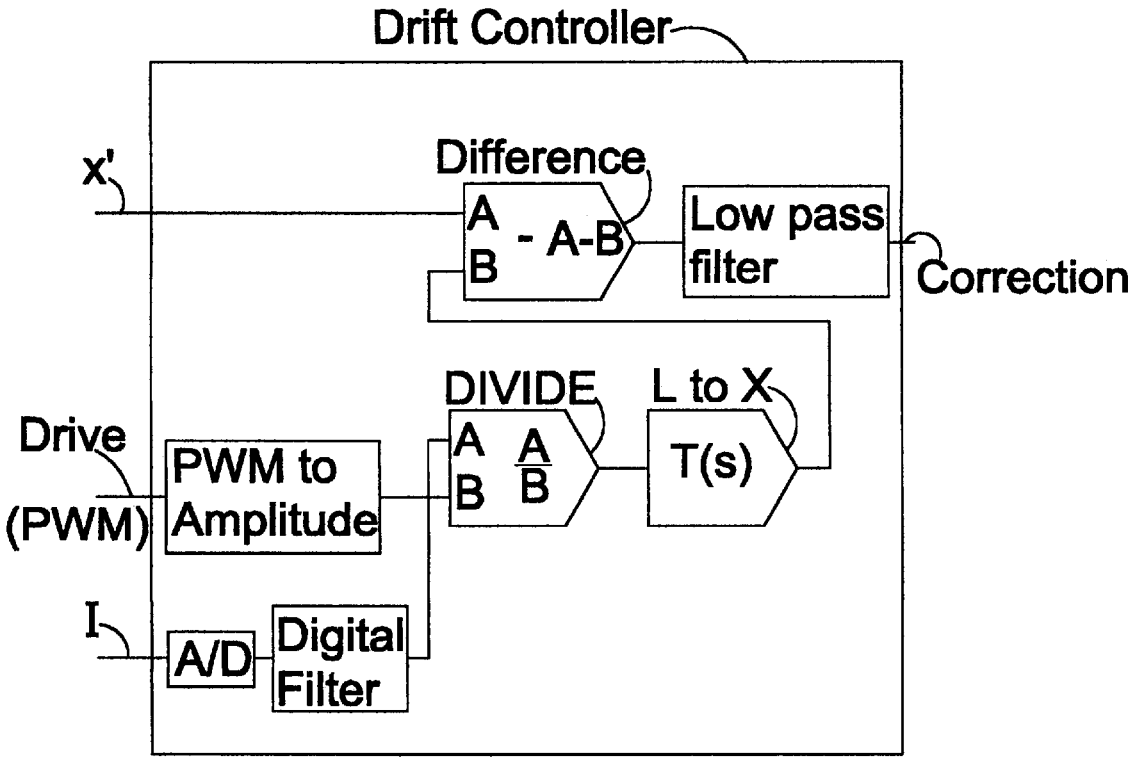
FIG. 8, shows a second embodiment of the drift controller that uses the high frequency signal from the PWM drive to calculate position.

FIG. 8 is another block diagram show correction, but this time utilizing the high frequency information present from the pulse width modulation (PWM) drive to the Solenoid System. Knowing the PWM drive signal it is easy to calculate, with computation block PWM to Amplitude, the amount of high frequency energy present in the PWM signal. The Digital Filter extracts the corresponding high frequency information from the digitized, sensed current (I) signal. The ratio of these two signals gives inductance. Inductance is then transformed into position in computation block L to X, compared with the current over flux (I/Φ) position X', and filtered. The filtered difference of this comparison is an approximation to the error in position and is applied to the Solenoid System as a correction.

DETAILED DESCRIPTION OF THE PREFERRED EMBODIMENT OF THE INVENTION

The simple closed loop feedback system of FIG. 5 can be adequate in many applications. The basic method of controlling flux in the solenoid core and computing position from the current and flux signals has been described. As mentioned, this system suffers from drift in the computation of the flux signal. This computation may either be in analog or digital hardware, or it could be completely contained in the software of the Control system. In any case, it is not possible to integrate the inductive voltage $V_L$ over indefinite periods of time without an error.

Some possible error sources are:

offset voltage in an analog integrator (e.g. U6 in FIG. 5)

a/d error (gain, offset, truncation) in measuring $V_L$ a/d error (gain, offset, truncation) in measuring I, when used to compute $V_L$ noise Drift in the integrator in FIGS. 2 and 3 can be modeled accurately enough as an error in the value of the resistance ($R_L$) of the coil. To correct drift, one just needs to correct the value of this resistance. The drift associated with the circuit of FIG. 1 can be modeled by an offset to the integrator's input. Both of these are terms that are integrated and therefore will grow with time. The intent of this new system is to exactly offset the inherent drift without causing any undesirable side effects. Although there are equivalent ways to consider this, the equating of the error to a term that affects the input of the integrator will be used from here on, realizing that there are other ways accomplish the same thing.

There are a number of procedures to control the long-term drift that can be placed into the Drift Controller of FIG. 6:

Current Control

Assume that the target parameter desired of the system is position X of a solenoid. This will be the case in the majority of systems. For many of these systems, the static drive current I required to maintain a static position X is known in advance, for all positions X attainable by the system. If the load is a function of position and does not vary in an unknown way over time, then it is possible to use the measured current as another piece of data in the closed loop control of the solenoid, e.g., as a measure of static position. The drift controller of the present invention represented in FIG. 6 can do the mapping of the target position X to the expected current I, compare this to the measured I, and produce an internal error term. This error term is then used to correct the system by changing the Correction signal which ultimately affects the integrator.

An important concept here, and in the methods to follow, is that the high frequency control is done by the current over flux (I/Φ) loop. The Correction applied to the resistance (to stop the integrator drift in FIGS. 2 and 3) is only from DC to a low frequency. The error term due to resistance cannot drift quickly, and in systems like those in FIGS. 2 & 3 is almost exclusively due to the thermal heating of the wire that makes up the coil of the solenoid. This heating could also be modeled and the major drift term could be reduced to 2nd order drift of the resistance. In any case the correction is typically small, and has little rapid change to it. Note that all voltages due to changes in the resistance are integrated by the flux integrator, resulting in an integral error that will grow with time. This is the equivalent to the integral term in a PID controller. The user must be careful to not allow multiple integrators to fight each other, and so the control of the controller of the present invention must be done with this in mind. The error drift for FIG. 1 will almost always be a simple, constant drift with time, since the heating of the solenoid does not usually cause changes in the integrator. This drift is therefore easily modeled with an offset to the integrator.

The major problem with the current control method is that changes in load will not be corrected, except for static changes that can be calibrated out when the system moves to a known location and the integrator can be initialized.

It may be possible to fix rapid load changes in this system, especially if the rapid load changes only occur during times of relative constant drive. The higher frequency current over flux (I/Φ) controller will detect the rapid load change and direct the system to come back to the target in the short time frame. As time progresses though, the controller will be confused by static load changes and will slowly drift to an incorrect location. Load changes will typically include both a static DC term and high frequency terms. The current over flux (I/Φ) controller will eliminate the high frequency terms, but the static DC term will slowly cause an error.

Current Change Control

For systems that are constantly moving it is possible to correct for load changes over a limited range. The transfer function between current and position is a function of all of the forces on the system. If the load on the system changes slowly, with respect to the motion, then in many solenoids it will be possible to solve the equations for position. This is not an easy calculation. The function relating flux to force is typically non-linear and the load is here considered to be constant (a linear function of position). The current over flux (I/Φ) controller gives a short-term accurate position and we have measured current. We can continuously solve the changes in all of these for a correction. This signal will have limited resolution and higher noise, but it can be filtered to produce a useable signal (see the discussion of filtering in the next section.)

The major problem with this technique is that it is only applicable for systems with continuous motion. It will correct for slowly changing loads. The combination of rapidly changing load with rapid motion will still be a problem, since it is not possible to solve the equations with both load and motion changing at once.

High Frequency Feedback

It is possible to measure the inductance of a solenoid using high frequency signals superimposed on the drive. By knowing the ratio of high frequency voltage to high frequency current, and the frequency applied, the inductance can be computed. The function relating inductance to position can be measured. Using this high frequency technique of obtaining inductance and then mapping (with the inductance vs position function) to position has been tried with varying degrees of success on solenoids in the past. Keeping the frequency high enough to not generate objectionable motion is required, but that can push the frequency into a region that is difficult to measure with sufficient accuracy and speed to allow control of the motion of the solenoid. The invention disclosed here solves this problem.

Since the current over flux (I/Φ) ratio in this disclosure already gives us high frequency position information, and the drift of that information is small and slow to change, we can generate a continuous slow correction by perturbing the drive at a sufficiently high frequency and observing the current. This observed signal, a small high frequency signal riding on top of the large DC term, will typically be noisy and we must apply an intelligent filtering algorithm to it. This gives us a measure of the inductance and after passing through a function, a measure of position. But unlike the systems that use this directly for position feedback, we are only using it to correct the small drift term. Comparing the two positions (computed from current over flux (I/Φ) vs. from the high frequency inductance) at a very low frequency yields an error value that is related to the drift in the integrator. The filtering only needs to produce data at a rate and amplitude to correct this drift. In fact the filter is only allowed to correct a small amount at a time. This also solves another problem that inductive feedback has traditionally had:

The back emf of rapid motion will cause a high frequency signal that is difficult to separate from the measurement of inductance.

Traditional systems relying upon an inductance measurement have had difficulty when motion, especially rapid motion, is present. This new system does not suffer from this problem since the filtered back emf signal, due to the motion of the solenoid, in the long run must go to zero. The solenoid simply cannot accelerate in one direction for any length of time without running into a stop. Over the slow time frame that the high frequency feedback loop operates, all of the back emf must average out to near zero. So continuous filtering and correction of the drift is possible.

The slow filtering algorithm needs to be done carefully so that the system is truly stable all of the time. This filter is first a low-pass filter. The current over flux (I/Φ) portion of the system is correcting all of the higher frequency terms leaving just the slow drift term to be corrected. This filter does not need to be a linear filter. Any number of lowpass, linear or non-linear filters could be adequate. What is minimally required is a filter that:

1. Removes the noise and high frequency terms of the drift correction method used
2. can slew adequately fast to follow the drift of the system
3. does not degrade the transient response of the complete system It is also possible to design the filter to be adaptive: i.e. extra information about position, such as position information from the landing at a mechanical stop, could "fine tune" the filter.

Calibration

These systems could be self calibrating. If it is possible to exercise the solenoid from a known condition (such as de-energized at a known position), the user can map the static characteristics of the transfer function relating current drive and position. This would be done using the known correct current over flux (I/Φ) position information before drift has had time to affect the measurement. This is desirable because an error in the current vs. position calibration will appear as a static load shift, and can be difficult to remove. The high frequency position drift system just discussed could also be calibrated with this technique, since any error in the function relating inductance with position will cause an error.

The errors in these functions can be confusing to observe. The higher frequency current over flux (I/Φ) loop will force motion that assumes that the initial position is correct, and it will drive motion using the current over flux (I/Φ) ratio. If all is correct then the motion will match the drive. But, for example, if the high frequency inductance measurement technique has a calibration error, then the flux will still settle to the correct value, for current over flux (I/Φ) is driven by feedback, while the position will be incorrect. Motion in the short time frame, driven by current over flux (I/Φ), may initially be correct but in the long time frame the motion will be driven by the incorrect inductance measurement. So the system will step quickly to one position and then slowly drift to another.

Although the present invention has been described with reference to particular embodiments, the range of application of the principles taught by the present invention will be better understood in relation to the following claims. All embodiments and their equivalents are covered by these claims.

What is claimed is:

1. A system for determining armature position in a solenoid subject to a drive voltage and using current and voltage data from the operation of a drive winding in the solenoid, comprising:

a) means for measuring the current flowing in the drive winding;

b) means for determining inductive voltage associated with the rate of change of flux linkage in the drive winding;

c) means for determining a flux integral, at least in part by integration of said inductive voltage over time;

d) means for computing a first measure of the armature position, said first measure being a function of the ratio of the current divided by said flux integral;

e) means for computing a second measure of the armature position independent of said first measure; and f) means for correcting cumulative drift in said flux integral from said first and second measures of the armature position to provide an indication of said flux linkage.

2. The system of claim 1, wherein said means for determining inductive voltage includes a sense winding and a means to measure sense winding voltage, said sense winding voltage being associated with said rate of change of said flux linkage in the drive winding.

3. The system of claim 1, wherein said means for determining inductive voltage includes means for determining a voltage applied to said drive winding and further includes means for correcting said voltage applied, based on the current in the drive winding and an estimate of resistance associated with the drive winding.

4. The system of claim 3, wherein said means for correcting said cumulative drift includes means for correcting said estimate of resistance.

5. The system of claim 1, further comprising servo feedback means for correcting said first measure of armature position toward a desired target measure, said servo feedback means causing said armature to settle to a stable position at a stable current, and wherein said means for computing said second measure of armature position includes means to infer said second measure of position from the current through the drive winding.

6. The system of claim 5, wherein said means for computing said second measure of armature position determines said second measure of position from the difference between the current measured through the drive winding and a known zero-drift value associated with the current when a mechanical force acting on the armature does not vary with time.

7. The system of claim 1, wherein the drive voltage includes a known high frequency component of voltage variation, said means for measuring the current through the drive winding includes means for measuring AC current at said known high frequency component, and wherein said means for computing said second measure of armature position includes use of said AC current.

8. The system of claim 7, wherein the drive voltage is generated by a known supply voltage switched by a pulse width modulation driver at a known frequency and known duty cycle, said known high frequency component of voltage variation is known as a function of said known supply voltage and said known frequency and said known duty cycle, and wherein said means for computing said second position measure uses the ratio of said known high frequency component of voltage to said AC current.

9. The system of claim 1, wherein said means for correcting said cumulative drift operates gradually and cumulatively, as a function of said first measure of armature position and said second measure of armature position, such that high frequency noise and actuation artifacts and motion artifacts in said second position measure are rejected.

10. The system of claim 1, wherein said means for correcting cumulative drift includes means to cause said first measure of armature position to be stable in relation to the armature position.

11. A system for measurement and servo feedback control of armature position in a solenoid subject to a controlled drive voltage using current and voltage data from the operation of a drive winding in the solenoid, the system comprising:

a) means for measuring the current flowing in the drive winding;

b) means for determining inductive voltage associated with the rate of change of flux linkage in the drive winding;

c) means for determining a flux integral, at least in part by integration of said inductive voltage over time;

d) means for computing a first measure of armature position, said first measure being a function of the ratio of the current in the drive winding divided by said flux integral;

e) means for computing a second measure of armature position independent of said first measure of armature position;

f) means for correcting cumulative drift in said flux integral from said first and second measures of armature position to provide an indication of said flux linkage; and, g) servo feedback means for setting the controlled drive voltage based on said first measure of armature position.

12. The system of claim 11, wherein said servo feedback means uses the setting of the controlled drive voltage to control said flux integral.

13. The system of claim 12, wherein said servo feedback means uses the control of said flux integral to control said first measure of armature position.

14. The system of claim 11, further comprising means to stabilize armature position while stabilizing said flux integral.

* * * * *